United States Patent [19]

Lonardi et al.

[11] Patent Number: 4,570,900

[45] Date of Patent: Feb. 18, 1986

[54] APPARATUS FOR ACTUATING A PROPORTIONING VALVE

[75] Inventors: Emile Lonardi, Bascharage; Victor Kremer, Luxembourg, both of Luxembourg

[73] Assignee: Paul Wurth S.A., Luxembourg, Luxembourg

[21] Appl. No.: 625,607

[22] Filed: Jun. 28, 1984

[30] Foreign Application Priority Data

Jun. 29, 1983 [LU] Luxembourg ..... 84890

[51] Int. Cl.[4] ..... F16K 31/122

[52] U.S. Cl. ..... 251/58; 74/471 R; 74/519; 251/212; 251/229; 251/232; 251/279

[58] Field of Search ..... 251/58, 212, 229, 232, 251/279, 280; 74/471 R, 519

[56] References Cited

U.S. PATENT DOCUMENTS

| | | | |
|---|---|---|---|
| 2,584,055 | 1/1952 | Smith | 74/471 R |
| 3,020,018 | 2/1962 | Stram | 251/280 |
| 3,317,179 | 5/1967 | Willis | 251/280 |
| 3,424,024 | 1/1969 | Derbfuss | 74/471 R |
| 4,158,367 | 6/1979 | Mailliet | 251/58 |
| 4,190,074 | 2/1980 | Mailliet et al. | 251/58 |
| 4,514,129 | 4/1985 | Legille et al. | 251/212 |

FOREIGN PATENT DOCUMENTS

| | | | |
|---|---|---|---|
| 2646618 | 4/1978 | Fed. Rep. of Germany . | |
| 0062770 | 10/1982 | Fed. Rep. of Germany . | |
| 457067 | 9/1913 | France . | |
| 1055606 | 2/1954 | France | 251/212 |
| 1147940 | 12/1957 | France | 251/212 |
| 1223273 | 6/1960 | France | 74/471 R |

*Primary Examiner*—G. L. Walton

*Attorney, Agent, or Firm*—Fishman & Dionne

[57] ABSTRACT

An apparatus for actuating a proportioning valve is presented. The valve consists of a pair of registers, each register having a cut-out portion defining a variable area orifice which is generally symmetrical about a central longitudinal axis through the orifice. The registers are respectively connected to a first and second drive shaft, the drive shafts being mounted about a common axis and being mounted in bearings in a frame such that by pivoting about the common axis, the drive shafts will urge the registers to simultaneously move in opposite directions. Each of the two drive shafts are provided with an arm which are pivotably connected to a tilting lever via a connecting rod. The two tilting levers are mounted on a pivot shaft which is parallel to the common axis of the two drive shafts. The tilting levers are also connected to a driving device, i.e., a hydraulic jack which acts to pivot them about their pivot shaft so that the registers are simultaneously actuated in opposite directions. Preferrably, one of the tilting levers is a substantially straight bar while the other of the tilting levers is a bent bar, the pivot shaft being connected between about the center portion of the straight bar and the bend portion of the bent bar.

7 Claims, 5 Drawing Figures

APPARATUS FOR ACTUATING A PROPORTIONING VALVE

BACKGROUND OF THE INVENTION

This invention relates to an apparatus for actuating a proportioning valve. More particularly, this invention relates to a new and improved apparatus for actuating a proportioning valve of the type disclosed and described in U.S. patent application Ser. No. 355,531, assigned to the assignee hereof, all of the contents of which are incorporated herein by reference.

A proportioning valve of the type described herein has been earlier disclosed in U.S. patent application Ser. No. 355,531 and acts to regulate the flow of material, i.e., charge material, from a storage enclosure located along the median axis of a shaft furnace charging installation. The proportioning valve described in U.S. patent application Ser. No. 355,531 has been particularly suitable for a charging installation of the type wherein the rate of flow of charge material is controlled by a metering device including a pair of overlapping register elements having cut-out portions which define a variable area aperture or orifice which is generally symmetrical abut a central longitudinal axis through the orifice. The U.S. patent application also set forths two alternative embodiments of a mechanism for actuating the valve, i.e., for simultaneously pivoting the two registers in opposite direction between an open position and a closed position.

While suitable for their intended purposes, the mechanisms for actuating the valve described in prior U.S. patent application Ser. No. 355,531 suffer from certain disadvantages and drawbacks. For example, the presence of gearings, racks or slide bars necessitate frequent maintenance and therefore high expense. Thus, the relatively complex construction of prior art actuating mechanism increases both manufacturing costs and maintenance costs.

SUMMARY OF THE INVENTION

The above discussed and other problems of the prior art are overcome or alleviated by the actuating apparatus for proportioning valves of the present invention. In accordance with the present invention, a novel apparatus for actuating a proportioning valve of this type disclosed in U.S. patent application Ser. No. 355,531 is provided which is simpler, more compact and more economical relative to the above-discussed prior art actuating devices.

In accordance with the present invention, an apparatus for actuating a proportioning valve is describes which consists of a pair of registers which have a generally spherical or cylindrical shape. Each of these registers is provided with a generally V shaped cut-out portion and the registers are mounted so as to overlap whereby the cut-outs will be placed in registration. The registers are simultaneously movable in opposite directions so as to cause the cut-out portions therein to define a delivery orifice of variable area which remains symmetrical with respect to the axis of a shaft furnace or the like. Each register is attached to a respective driving shaft. The driving shafts are positioned co-axial with respect to each other and are mounted in the bearings of a frame so that, by pivoting about their common axis, the shafts will cause the registers to move in opposite directions. Each of the two drive shafts is provided with an arm, each arm being jointed via a connecting rod to a tilting lever mounted on a pivot shaft, the pivot shaft being parallel to the common axis of the two driving shafts. The tilting levers are connected to a driving device, i.e., hydraulic jack or other suitable motor, the driving device acting to pivot the tilting levers about the pivot shaft. An important feature of the present invention is that the connections between one of the tilting levers and its connecting rod is located at a different angle on the pivot shaft than the connection between the other tilting lever and the connecting rod thereof. This type of construction will permit the two registers to be actuated in opposite directions during the operation of the driving device.

In a preferred embodiment of the present invention, one of the tilting levers consists of a substantially straight bar while the other tilting lever is a bent bar. The tilting lever is then pivotably mounted between about the middle of the straight bar and the bend portion of the bent bar.

The above discussed and other advantages of the present invention will be apparent to and understood by those skilled in the art from the following detailed described and drawings.

BRIEF DESCRIPTION OF THE DRAWING

Referring now to the drawings, wherein like elements are numbered alike in the several Figures.

DESCRIPTION OF THE PREFERRED EMBODIMENT

Figure 1:
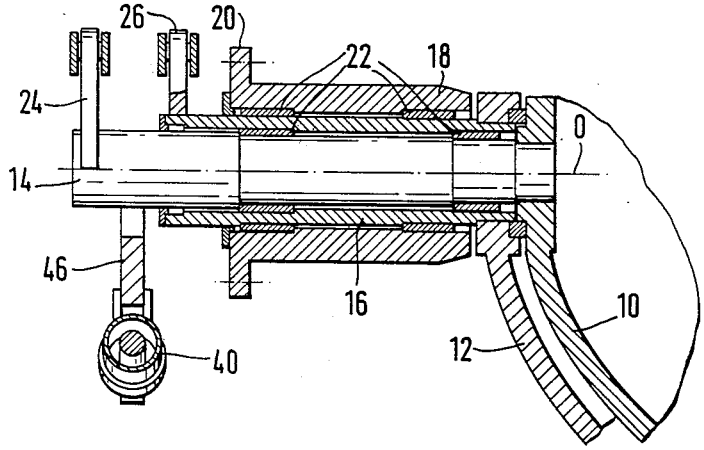
FIG. 1 is a elevation view, partly in cross-section, of an apparatus in accordance with the present invention along the line I—I of FIG. 2.

Referring first to FIG. 1, two registers 10 and 12 having the shape of a spherical or cylindrical cap are shown. The registers 10 and 12 are identical to those described in U.S. patent application Ser. No. 355,531. Accordingly, additional explanatory details relating to the operation and assembly of this valve can be obtained with reference to the prior patent application.

As discussed in the above mentioned patent application, upper register 10 is connected to a driving shaft 14 which is positioned co-axially within a second driving shaft 16, driving shaft 16 being connected to lower register 12. These two shafts 14 and 16 are mounted within a bearing 18 of a fixed frame 20. Sleeves 22 positioned between shaft 14, bearing 18 and fixed frame 20 permit relative rotation between the two shafts 14 and 16 about the common axis 0 and between the shafts 14 and 16 and the frame 20.

It will be appreciated that the apparatus which actuates the driving shafts 14,16 to rotate about the common axis 0 so as to open and close registers 10 and 12 must actuate shafts 14,16 simultaneously and in opposite directions. This actuation of registers 10 and 12 is effected by the actuating apparatus of the present invention and will be described below in more details with referenece to FIGS. 2 and 3 and the corresponding perspective views in FIGS. 4 and 5.

Figure 2:
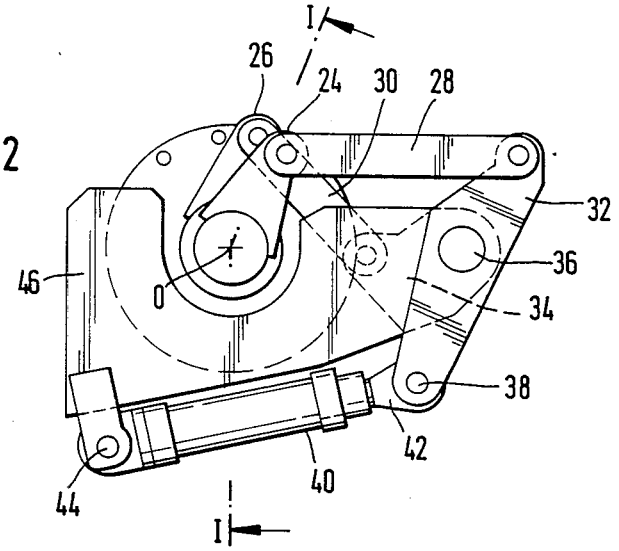
FIG. 2 is a side elevation view of the actuating apparatus of the present invention with the valve in the closed position.
Figure 3:
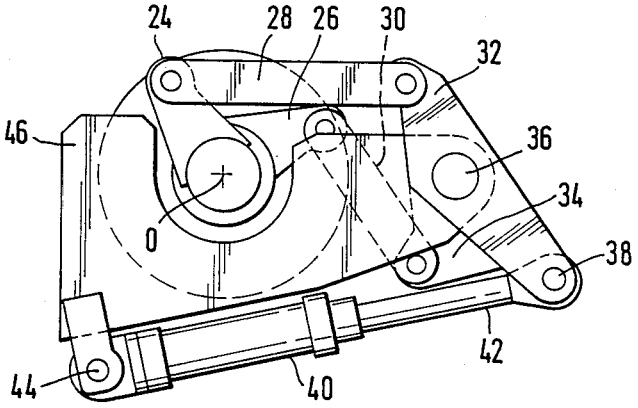
FIG. 3 is a side elevation view similar to FIG. 2, but with the valve in the open position.
Figure 4:
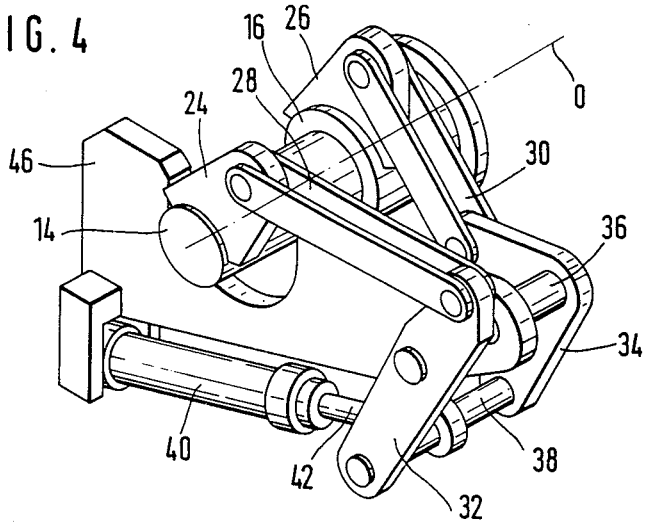
FIG. 4 is a perspective view of the actuating apparatus in accordance with the present invention in the position shown in FIG. 2.

Referring simultaneously to FIGS. 2 thru 4, shafts 14 and 16 are rigidly connected to arms 24 and 26, respectively. In turn, arms 24 and 26 are pivotably connected to the respective first ends of connecting rods 28 and 30. The second opposite ends of the two connecting rods 28 and 30 are pivotably connected to the first respective ends of tilting levers 32 and 34. Tilting levers 32 and 34 are pivotably mounted on a common shaft 36, common shaft 36 being parallel to the axis 0 of the two driving shafts 14 and 16. The two tilting levers 32 and 34 are also interconnected at their opposite second ends by means of a bar 38 such that the two levers 32 and 34 will pivot simultaneously about the shaft 36. In a preferred embodiment, levers 32 and 34 should be interconnected still further by means of cross pieces (not shown) to form a firmer and stronger construction.

The pivoting motion of tilting levers 32 and 34 is provided by a driving device such as hydraulic jack 40 which is pivotably mounted in a pivot 44, pivot 44 being supported by plate 46 which is intregal with frame 20. Hydraulic jack 40 includes piston 42 which in turn, is pivotably connected to about the center of bar 38. It will be appreciated that hydraulic jack 40 may be replaced by another suitable driving device such as a motor.

Figure 5:
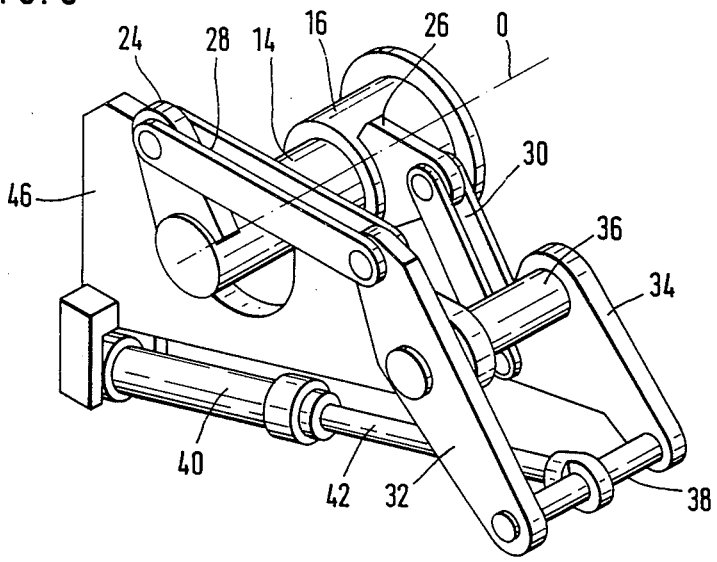
FIG. 5 is a perspective view of the actuating apparatus in accordance with the present invention in the position shown in FIG. 3.

As shown in FIGS. 4 and 5, connecting rods 28 and 30 each consist of a pair of identical, spacially displaced members. It should be understood that these double elements which comprise rods 28 and 30 may instead be replaced with single elements having forked ends or any other suitable alternatives. It should also be understood that levers 32 and 34 and arms 24 and 26 may be constructed as double elements. Similarly, tilting levers 32 and 34 may be combined as a single unit, in which case they would have to be provided with forks so as to be engagable by connecting rods 28 and 30. In such an alternative embodiment however, the supporting plate 46 would also have to be comprised of a double construction.

Note that instead of providing jack 40 as shown in the drawings, the jack may also be positioned in accordance with the space available, on the opposite side relative to shafts 14 and 16 with a corresponding requisite modification to levers 32 and 34.

An important structural feature in accordance with the actuating apparatus of the present invention is the particular configuration of tilting levers 32 and 34. It is important that tilting levers 32 and 34 are designed such that their respective pivotal connections with rods 28 and 30, during the pivoting movements of levers 32 and 34, takes places on the opposite sides of a plane defined by the axis 0 and the common pivot shaft 36 (see FIG. 3). To achieve this result, in a preferred embodiment, one of the tilting levers, for example 32, consists of a substantially straight bar having a central or middle portion which is mounted on pivoting shaft 36. In contrast, the other tilting lever, for example tilting lever 34, is a bent bar wherein the bend portion is mounted on the pivoting shaft 36 (see FIGS. 4 and 5). As a consequence of this particular structural arrangement and lever shape, registers 10 and 12 will be actuated in opposite directions during the operation of the hydraulic jack 40. Thus, in operating jack 40 from the closed position shown in FIG. 2 to the open position of the registers shown in FIG. 3, arm 24 will actuate the upper register 10 so as to pivot register 10 in a counter clockwise direction while arm 26 will actuate lower register 12 so as to pivot register 12 in a clockwise direction.

In order to insure that the opening defined by registers 10 and 12 will always be symmetrical with respect to a central longitudinal axis, the coordination of the movements of the registers is effected by the selection of appropriate transmission ratios of levers 32 and 34, the length of arms 24 and 26, the length of tilting levers 32 and 34, the distances between shafts 36 and the axis 0 and also, the starting angles on the one hand, between arm 26 and the plane defined by the axis 0 of shaft 36, and on the other hand, the lever arm 34 about shaft 36 in the aforementioned plane in the position shown in FIG. 2. For example, since the radius of lower register 12 is different from that of upper register 10, the amplitude of the pivoting movement of the upper register 10 has to be slightly modified in order to avoid obtaining an opening between the registers which becomes increasing asymmetrical. This modification can be achieved by suitably calculating the length of the aforementioned radius.

The apparatus for actuating proportioning valve in accordance with the present invention provides many features and advantages over prior art actuating devices. For example, unlike the prior art, the present invention does not necessitate the use of gearings, racks or slide bars. Accordingly, maintenance requirements and overall costs are reduced.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An apparatus for actuating a proportioning valve, the valve consisting of a pair of registers, each register having a cut-out portion defining a variable area orifice which is generally symmetrical about a central longitudinal axis through the orifice, the registers being respectively connected to a first and second drive shaft, the drive shaft being mounted coaxially with respect to each other about a common axis including:

first and second arm means, said first arm means being connected to said first drive shaft at a first end thereof and said second arm means being connected to said second drive shaft at a first end thereof;

first and second connecting rod means being pivotably and respectively connected at first ends thereof to second ends of said first and second arm means;

first and second tilting lever means, each tilting lever means being pivotally connected to a second end of said connecting rod means, said lever means being mounted on pivot shaft means, said pivot shaft means being parallel to said common axis of said drive shaft;

said pivotable connection between said first tilting lever means and said first connecting rod means and said pivotable connection between said second tilting lever means and said second connecting rod means being on opposite sides of the plane defined by said common axis and said pivot shaft means; and driving means, said driving means urging said first and second tilting lever means to pivot about said pivot shaft means wherein said registers are simultaneously actuated in opposite directions.

2. The apparatus of claim 1 wherein:

said first tilting lever means comprises a substantially straight bar;

said second tilting lever means comprises a bent bar and wherein; and said pivot shaft means is connected between about the center portion of said first tilting lever means and the bend portion of said second tilting lever means.

3. The apparatus of claim 1 wherein said driving means comprises:

hydraulic jack means, said hydraulic jack means including a piston rod.

4. The apparatus of claim 1 including:

rigid support means interconnecting said first and second tilting levers.

5. The apparatus of claim 3 including:

rigid support means interconnecting said first and second tilting levers.

6. The apparatus of claim 5 wherein:

said piston rod is pivotably connected to said rigid support means.

7. The apparatus of claim 1 wherein:

said drive shafts are mounted in bearings in a frame.

* * * * *